United States Patent [19]

Vall

[11] 4,157,073

[45] Jun. 5, 1979

[54] METHOD FOR SILENCING HALYARDS

[76] Inventor: Seymour Vall, 35 W. 81st St., New York, N.Y. 10024

[21] Appl. No.: 862,956

[22] Filed: Dec. 21, 1977

[51] Int. Cl.[2] ..... B63H 9/04

[52] U.S. Cl. ..... 114/102; 114/111

[58] Field of Search ..... 191/41; 114/108, 111, 114/113, 114, 39, 218, 101, 102

[56] References Cited

U.S. PATENT DOCUMENTS

| | | | |
|---|---|---|---|
| 1,589,619 | 6/1926 | Birch | 191/41 |
| 3,343,514 | 9/1967 | Brett | 114/108 |
| 3,996,873 | 12/1976 | Weghorn | 114/108 |

*Primary Examiner*—Trygve M. Blix
*Assistant Examiner*—D. W. Keen

[57] ABSTRACT

Halyards may be secured by capturing such halyards inside the turns of a plastic helix and then also concurrently capturing a shroud or other securing line within said helix.

6 Claims, 1 Drawing Figure

METHOD FOR SILENCING HALYARDS

BACKGROUND OF THE INVENTION

Halyards are the lines used to raise and lower the sails of a sailing yacht. They are led from a point near the base of the mast, through a block at or near the top of the mast and down to the peak of the sail. When the sails are lowered and the vessel is at its mooring the halyards and other lines attached to the mast tend to slap against the mast. This constant action creates wear on the spreaders and other fittings on the mast. It also chafes the halyards. In addition, the resultant noise is disturbing to the occupants of nearby vessels.

To correct the wear and noise condition it is a common practice to tie the halyards to a shroud (a wire mast support on either side of the mast) with light line, ribbons or shock cord. While this method works, lines and ribbons require knots which are difficult to release in the dark or when wet. Shock cords and hook devices tend to have a short life. In any case, line ribbons and shock cords are usually removed from the shrouds while the vessel is underway and are never on hand when needed.

The state of the art is readily seen from representative U.S. patents. Thus, in U.S. Pat. No. 3,343,514 means for securing a halyard to a mast are shown. Similarly, U.S. Pat. No. 3,996,873 describes an L-shaped member attached to the mast for securing the halyards of sailboats in a fixed position, thereby allowing the winches used to raise the sails to be used for other purposes.

In U.S. Pat. No. 3,826,223 a flag clasp containing a clew for silencing a flagpole halyard in windy conditions is described. The clew encircles the inner halyard run and any lateral movement of the outside halyard, by reason of wind or the like, will result in the inside halyard's movement with the outside halyard rather than in opposite direction in which it contacts the flagpole creating a noise condition.

DESCRIPTION OF THE INVENTION

The present invention relates to a novel method for providing a quick, positive and convenient means of silencing the halyards of a sailing yacht.

In the present method there is employed as a halyard securing means an open ended helical coil fabricated from a tough, semi-rigid material such as a plastic rod. Preferred plastics useful for preparing such a coil include rigid poly vinyl chloride, polyethylene and polypropylene. In a preferred embodiment the rod used in forming the coil is $\frac{1}{4}$ to $\frac{3}{8}$ inches thick, the coil will have from $2\frac{1}{2}$ to $3\frac{1}{2}$ turns in its helix with a distance of about 3/16 inch between turns. The coil can be formed from the plastic rod by procedures well known in the plastic fabricating art.

The resultant helical coil of the preferred embodiment will have a gross cylindrical shape with an inside diameter of about $1\frac{1}{2}$ inches and a height of about $1\frac{1}{2}$ to $2\frac{1}{2}$ inches depending on the number of turns employed.

The method of the present invention is practiced by placing either end of the coil against the shroud so that the shroud is between the end of the plastic rod and the adjacent turn. The coil is rotated around the shroud until all turns of the coil completely encircle the shroud.

To silence the halyards, they are introduced into the turns of the coil as above and are restrained from free motion by being coupled to the shrouds.

Release of the halyards is accomplished by reversing the entrapping procedure. The halyards may be freed without removing the coils from the shrouds.

When not in use the coils may be allowed to drop down over the shroud turnbuckles where they will not interfere with the working of the boat.

A further advantage in employing the plastic helix coil in the present invention is the fact that should, for any reason, such helix coil drop on deck and be stepped on, it will flex but will not break.

DETAILED DESCRIPTION OF THE INVENTION

Figure 1:
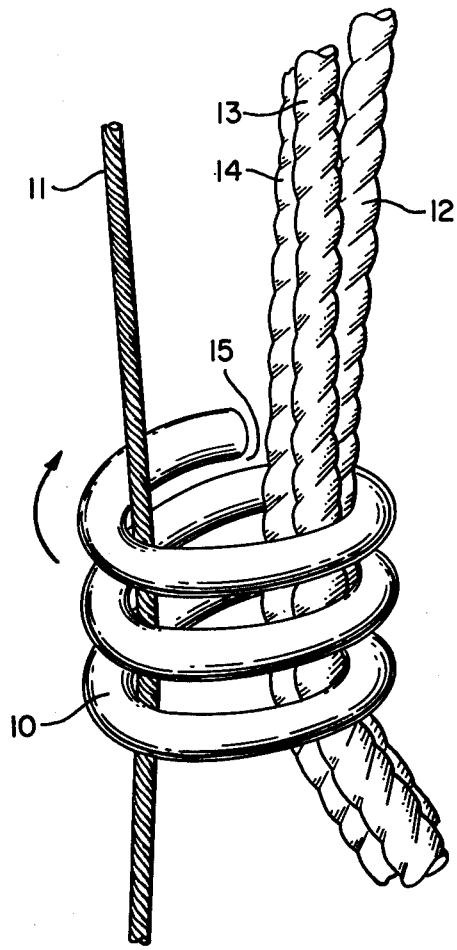
FIG. 1 is a three-dimensional view of the helix coil in position on a shroud, encompassing halyards.

The method of the present invention is more clearly understood by reference to the accompanying FIG. 1 wherein a diagrammatic view of the aforesaid helix coil is shown in operating position with entrapped halyards and shrouds. Turning specifically to FIG. 1, helix coil 10 is seen encircling shroud 11 and simultaneously entrapping halyards 12, 13 and 14. Insertion of the halyards and shrouds within the turns of the helix coil is accomplished by introducing such members into the coil through gap 15 and thereafter rotating said coil in the direction of the arrow for a sufficient number of turns to effectuate entrapment.

I claim:

1. A method for restraining the halyards of a sailing yacht having shrouds on its mast so as to silence said halyards and prevent undue wearing periods of non-use, which method comprises providing an open-ended helical coil and installing said halyards and shrouds completely within the turns of said helical coil.

2. The method of claim 1 wherein said helical coil is fabricated from a tough, semi-rigid plastic rod.

3. The method of claim 2 wherein said rod is about $\frac{1}{4}$ to $\frac{3}{4}$ inch thick.

4. The method of claim 1 wherein said helical coil has about $2\frac{1}{2}$ to $3\frac{1}{2}$ turns.

5. The method of claim 1 wherein said helical coil has a diameter of about $1\frac{1}{2}$ inches and a height of about $1\frac{1}{2}$ to $2\frac{1}{2}$ inches.

6. The method of claim 1 wherein said halyards and said shrouds are installed within said helical coil by placing either end of said coil against said halyards or shrouds so that said halyards or shrouds are between the end of said coil and the adjacent turn and rotating said coil around said halyards or shrouds until all turns of the coil completely encircle said halyards or shrouds.

* * * * *